US012680026B2

(12) United States Patent
Algozeeb et al.

(10) Patent No.: US 12,680,026 B2
(45) Date of Patent: Jul. 14, 2026

(54) METHOD OF PRODUCING ACTIVATED CARBON

(71) Applicant: Saudi Arabian Oil Company, Dhahran (SA)

(72) Inventors: Wala Algozeeb, Alkhobar (SA); Amer Al-Tuwailib, Qatif (SA); Ibrahim Al-Zahrani, Dammam (SA)

(73) Assignee: Saudi Arabian Oil Company, Dhahran (SA)

( * ) Notice: Subject to any disclaimer, the term of this patent is extended or adjusted under 35 U.S.C. 154(b) by 604 days.

(21) Appl. No.: 18/137,172

(22) Filed: Apr. 20, 2023

(65) Prior Publication Data

US 2024/0352321 A1 Oct. 24, 2024

(51) Int. Cl.

| | |
|---|---|
| ***C10B 57/06*** | (2006.01) |
| ***C10B 57/04*** | (2006.01) |
| ***C10G 9/06*** | (2006.01) |

(52) U.S. Cl.

CPC ..... *C10B 57/06* (2013.01); *C10B 57/045* (2013.01); *C10G 9/06* (2013.01); *C10G 2300/1037* (2013.01); *C10G 2300/301* (2013.01); *C10G 2300/305* (2013.01); *C10G 2300/4006* (2013.01); *C10G 2300/4012* (2013.01); *C10G 2300/80* (2013.01)

(58) Field of Classification Search

CPC ..... C10B 57/045; C10B 57/06; C10G 9/06; C10G 2300/1037; C10G 2300/301; C10G 2300/305; C10G 2300/4006; C10G 2300/4012; C10G 2300/80

See application file for complete search history.

(56) References Cited

U.S. PATENT DOCUMENTS

| | | | | |
|---|---|---|---|---|
| 2,257,907 | A | 10/1941 | Griswold | |
| 5,871,618 | A * | 2/1999 | Lee | C10M 175/0033 202/84 |
| 7,691,782 | B2 | 4/2010 | Tanaka | |
| 9,287,556 | B2 | 3/2016 | Neumann et al. | |
| 9,597,656 | B2 | 3/2017 | Tour et al. | |
| 10,654,027 | B2 | 5/2020 | Dias et al. | |
| 10,683,644 | B2 | 6/2020 | Kim et al. | |
| 10,960,347 | B1 | 3/2021 | Wang et al. | |
| 11,059,838 | B2 | 7/2021 | Yaghi et al. | |
| 2004/0238406 | A1 * | 12/2004 | Kanataev | C10G 47/22 208/108 |

(Continued)

FOREIGN PATENT DOCUMENTS

| | | |
|---|---|---|
| AU | 2021203633 | 7/2021 |
| CN | 105869912 | 6/2018 |
| CN | 109019590 | 4/2020 |

(Continued)

OTHER PUBLICATIONS

Human assisted machine translation of JP50113492. (Year: 1974).*

(Continued)

*Primary Examiner* — Brian A Mccaig
(74) *Attorney, Agent, or Firm* — Fish & Richardson P.C.

(57) ABSTRACT

A method of producing activated carbon includes pyrolyzing a hydrocarbon feedstock in the presence of a salt. The hydrocarbon feedstock includes a gas hydrocarbon, a liquid hydrocarbon, or both. The salt includes an alkali metal, an alkaline earth metal, or both.

20 Claims, 14 Drawing Sheets

(56) References Cited

U.S. PATENT DOCUMENTS

| | | | |
|---|---|---|---|
| 2021/0061654 | A1 | 3/2021 | McFarland et al. |
| 2023/0233989 | A1 | 7/2023 | McGrail et al. |

FOREIGN PATENT DOCUMENTS

| | | | | |
|---|---|---|---|---|
| CN | 113697807 | B | | 6/2023 |
| JP | 50113492 | A | * | 2/1974 |
| JP | 4349627 | | | 10/2009 |
| KR | 20200086352 | A | | 7/2020 |
| WO | WO 2013169811 | | | 11/2013 |
| WO | WO 2017205960 | | | 12/2017 |
| WO | WO 2020046582 | A | | 3/2020 |
| WO | WO 2021076670 | | | 4/2021 |

OTHER PUBLICATIONS

Gary, J.H., et al., 2007, Petroleum Refining Technology and Economics, 5th ed., CRC Press, 465 pp. (Office action cites Figure 1.1). (Year: 2007).*

Speight, J.G., 1998, The Chemistry and Technology of Petroleum, 3rd ed., Marcel Dekker, 918 pp. (Office action cites Table 1-3). (Year: 1998).*

Du et al., "Synthesis of sulfur-doped porous carbon from heavy coker gas oil and its application in CO2 capture," Materials Advances, Dec. 2020, 2:248-252, 5 pages.

U.S. Appl. No. 18/465,597, filed Sep. 12, 2023, Algozeeb et al.

U.S. Appl. No. 18/788,654, filed Jul. 30, 2024, Algozeeb et al.

ASTM-D287-22, "Standard Test Method for API Gravity of Crude Petroleum and Petroleum Products (Hydrometer/Method)," Current edition approved Dec. 1, 2022, 7 pages.

Mestre et al., "Chapter 2—Nanoporous Carbon Synthesis: An Old Story with Exciting New Chapters," Porosity—Process, Technologies and Applications, 2018, pp. 37-68, 32 pages.

Algozeeb et al., "Plastic Waste Product Captures Carbon Dioxide in Nanometer Pores," ACS Nano, Apr. 2022, 25 pages.

Bai et al., "Preparation and carbon dioxide uptake capacity of N-doped porous carbon materials derived from direct carbonization of zeolitic imidazolate framework," Carbon, Nov. 2014, 79:213-226, 14 pages.

Hong et al., "$CO_2$ Capture in the Sustainable Wheat-Derived Activated Microporous Carbon Compartments," Scientific Reports, Oct. 2016, 6(1):34590, 10 pages.

Jalilov et al., "Asphalt-Derived High Surface Area Activated Porous Carbons for Carbon Dioxide Capture," ACS Applied Materials & Interfaces, 2015, 7(2):1376-1382, 7 pages.

Li et al., "Preparation of a dual Pore Structure Activated Carbon from Rice Husk Char as an Adsorbent for $CO_2$ Capture," Fuel Processing Technology, Apr. 2019, 186:35-39, 5 pages.

Serafin et al., "Management of surgical mask waste to activated carbons for $CO_2$ capture," Journal of CO2 Utilization, Mar. 2022, 59:101970, 17 pages.

Sevilla et al., "Optimization of the Pore Structure of Biomass-Based Carbons in Relation to Their Use for CO2 Capture under Low- and High-Pressure Regimes," ACS Applied Materials & Interfaces, Jan. 2018, 10(2), 32 pages.

Singh, et al., "A facile synthesis of activated porous carbon spheres from d-glucose using a non-corrosive activating agent for efficient carbon dioxide capture," Applied Energy, Dec. 2019, 255:113831, 12 pages.

Yuan et al., "5 Ultramicropore-rich renewable porous carbon from biomass tar with excellent adsorption capacity and selectivity for $CO_2$ capture," Chemical Engineering Journal, Oct. 2019, 373:171-178, 8 pages.

Yuan et al., "Valorization of waste polyethylene terephthalate plastic into N-doped microporous carbon for $CO_2$ capture through a one-pot synthesis," Journal of Hazardous Materials, Nov. 2020, 399:123010, 9 pages.

Yue et al., "Efficient $CO_2$ Adsorption on Nitrogen-Doped Porous Carbons Derived from d-Glucose," Energy Fuels, May 2018, 32(6), 34 pages.

Chen et al., "Engineering the efficient three-dimension hollow cubic carbon from vacuum residuum with enhanced mass transfer ability towards H2O2 production," Chinese Journal of Chemical Industry Press, Oct. 2020, 30:98-105, 8 pages.

Li et al., "Ultrasound-assisted successive recovery of chemical activation agent and synthesis of high sulfur petroleum coke-based carbon anode with progressively improving performance K-ion storage," Applied Energy, Jul. 2023, 348:121567, 12 pages.

Pan et al., "3D interconnected honeycomb-like and high rate performance porous carbons from petroleum asphalt for supercapacitors," Applied Surface Science, Jun. 2018, 444:739- 746, 8 pages.

Rashidi et al., "Co-valorization of delayed petroleum coke-palm kernal shell for activated carbon production," Journal of Hazardous Materials, Sep. 2020, 9 pages.

International Search Report and Written Opinion in International Appln. No. PCT/US2024/046014, mailed on Jan. 24, 2025, 17 pages.

SAIP Examination Report in Saudi Arabian Appln. No. 1020242069, mailed on Nov. 20, 2025, 15 pages (with English translation).

* cited by examiner

METHOD OF PRODUCING ACTIVATED CARBON

FIELD

The disclosure relates to the conversion of hydrocarbon feedstocks to solid activated carbon, wherein the hydrocarbon feedstock includes a gas hydrocarbon, a liquid hydrocarbon, or both.

BACKGROUND

Activated carbon is typically synthesized from solid biomass. For example, precursors can include coconut shells, corn cobs, or wood. However, biomass is limited in quantity and varies in quality. Furthermore, these processes typically require heavy processing, which is done over multiple steps at high temperatures. The first step is typically charring or carbonization of the biomass which takes place at 500-700° C., followed by activation of the carbon which typically requires an activation reagent such as $CO_2$ gas, potassium hydroxide, phosphoric acid, or zinc chloride and a temperature of 750-1500° C.

SUMMARY

The disclosure relates to a method for converting hydrocarbon feedstocks to activated carbon. The methods disclosed herein can be used to convert feedstocks typically considered as low in value, including crude oil derived feeds such as light cycle oil, to a higher value highly porous activated carbon product that can be used in many applications, such as water purification, gas separation, air purification, and odor control. The method carbonizes liquid or gas hydrocarbon feedstocks in the presence of relatively inexpensive salts.

The disclosure provides a method of producing activated carbon including pyrolyzing a hydrocarbon feedstock in the presence of a salt, wherein the hydrocarbon feedstock comprises a gas hydrocarbon, a liquid hydrocarbon, or both; and the salt comprises an alkali metal, an alkaline earth metal, or both.

DETAILED DESCRIPTION

Unless otherwise defined, all technical and scientific terms used in this document have the same meaning as commonly understood by one of ordinary skill in the art to which the present application belongs.

The method disclosed herein provides a procedure for activated carbon synthesis along with the thermal cracking of a hydrocarbon feedstock. The method can be carried out by the carbonization of a hydrocarbon feedstock in the presence of a salt. The hydrocarbon feedstock can be a petroleum cut, such as a low-boiling point (light) and/or highly aromatic petroleum cut. The method can produce highly porous activated carbon with precise control over surface area and pore size distribution. Further, this method allows for production of activated carbon with less processing that is required for biomass feedstocks in order to obtain porous carbon.

Provided herein is a method of producing activated carbon including pyrolysis of a hydrocarbon feedstock in the presence of a salt. The hydrocarbon feedstock can include a gas hydrocarbon, a liquid hydrocarbon, or both. The salt includes an alkali metal, an alkaline earth metal, or both.

As used in this disclosure, the term "pyrolysis" refers to a thermal decomposition reaction performed at an elevated temperature. An example pyrolytic reaction is a carbonization reaction that converts organic material feedstock into solid carbon.

Figure 1:
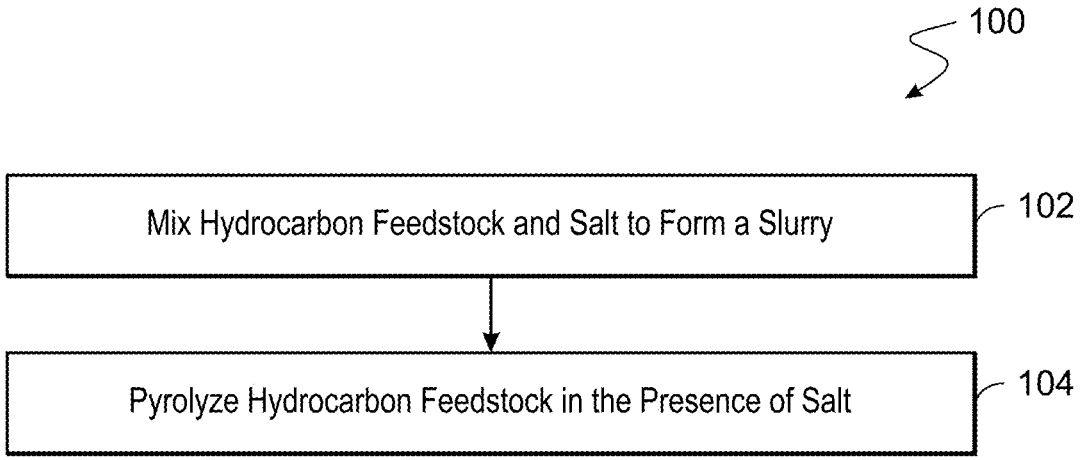
FIG. 1 is a flow diagram for a method.
Figure 2:
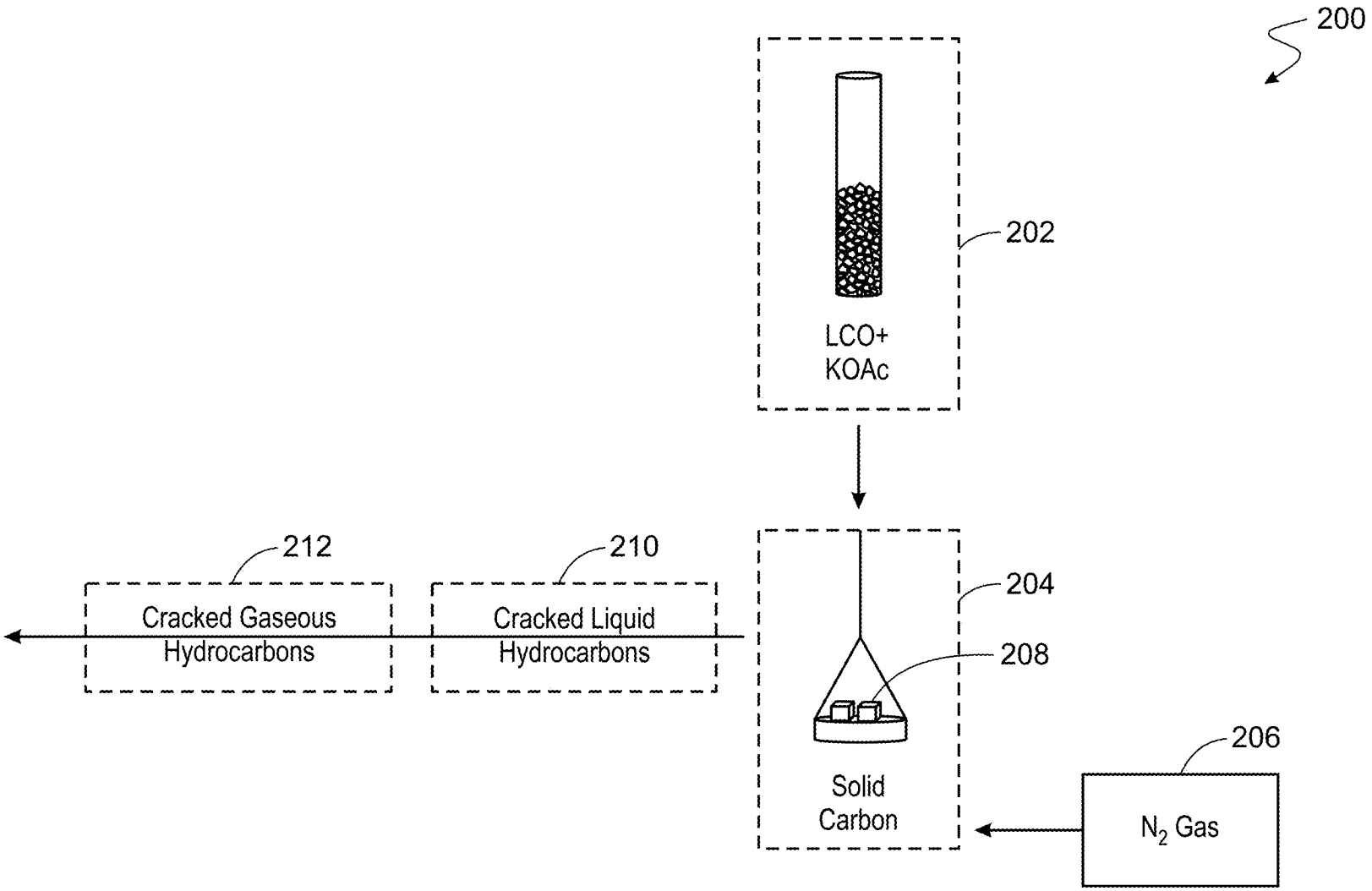
FIG. 2 depicts an example method of producing activated carbon.

FIG. 2 depicts a flowchart 100 for a method of producing activated carbon. In optional step 102, a hydrocarbon feedstock and a salt are mixed to form a slurry. In step 104, pyrolysis of the hydrocarbon feedstock is carried out in the presence of a salt. In some embodiments, step 104 includes pyrolysis of the slurry formed in step 102 including the hydrocarbon feedstock and the salt.

Any liquid or gas hydrocarbon feedstock can be used in the pyrolysis reaction. In some embodiments, the hydrocarbon feedstock includes a liquid hydrocarbon. In some embodiments, the hydrocarbon feedstock is derived from crude oil. For example, the hydrocarbon feedstock includes a petroleum cut.

In some embodiments, the hydrocarbon feedstock includes a cracking product. For example, a fluid catalytic cracking (FCC) product such as cycle oil. For example, the hydrocarbon feedstock includes light cycle oil, heavy cycle oil, or both.

As used in this disclosure, the term "cycle oil" refers to a liquid hydrocarbon product from fluid catalytic cracking that includes a mixture of hydrocarbons having a boiling point range within about 150° C. to about 600° C. In some embodiments, cycle oil has an API gravity ranging from 10 to 20 degrees. Cycle oil is typically considered to be low in value. It is typically hydrotreated to raise its cetane number and then is blended into diesel.

As used in this disclosure, the term "light cycle oil" or LCO refers to a diesel range product from fluid catalytic cracking (FCC) that includes a mixture of hydrocarbons having a boiling point range of about 150° C. to about 400° C. In some embodiments, at least about 90% of the mixture of hydrocarbons has a boiling point range of about 200° C. to about 350° C., Light cycle oil has a high aromatics content and a low over all cetane number. In some embodiments, LCO includes a mixture of hydrocarbons having carbon numbers predominantly in the range of C9 to C20.

As used in this disclosure, the term "heavy cycle oil" or HCO refers to a product from FCC processes that includes a mixture of hydrocarbons having a boiling point range within about 180° C. to about 600° C., such as primarily about 300° C. to about 600° C. For example, at least about 90% of the mixture of hydrocarbons has a boiling point range of about 300° C. to about 600° C. HCO typically has a large amount of polycyclic aromatic hydrocarbons.

FIG. 2 shows an example method 200 of producing activated carbon using a light cycle oil (LCO) feedstock. The LCO is mixed with potassium acetate (KOAc) to form a slurry 202. The mixture of LCO and KOAc is pyrolyzed in a furnace 204 under nitrogen gas 206 at a temperature of about 600° C. to about 650° C. to yield solid activated carbon 208, liquid cracked hydrocarbons, and gaseous cracked hydrocarbons. Upon heating the mixture of LCO and KOAc, the solid activated carbon 208 forms in a sample holder. Once the furnace 204 is cooled down, the solid activated carbon 208 can be collected. In some embodiments, the solid activated carbon 208 is washed with water and filtered. The liquid cracked hydrocarbons are collected in a cold trap 210 at −195.8° C. The gaseous cracked hydrocarbons evolve out into a gas analyzer 212, and are analyzed at 100° C.

The light cycle oil can include a mixture of hydrocarbons having a boiling point range of about 150° C. to about 400° C., about 150° C. to about 375° C., about 160° C. to about 360° C., about 150° C. to about 350° C., or about 175° C. to about 300° C.

The light cycle oil can include a mixture of hydrocarbons having a cetane number in a range of about 15 to about 25, about 18 to about 22, about 19 to about 21, about 20 to about 22, or about 20 to about 21. In some embodiments, the light cycle oil has a cetane number of about 20, or about 20.1.

In some embodiments, the hydrocarbon feedstock includes heavy cycle oil. The heavy cycle oil can include a mixture of hydrocarbons having a boiling point range of about 300° C. to about 600° C., about 350° C. to about 575° C., about 350° C. to about 500° C., or about 400° C. to about 600° C.

The pyrolysis reaction to produce the activated carbon is carried out in the presence of a salt. The salt can act as an activating reagent to facilitate the carbonization of the hydrocarbon feedstock. In some embodiments, the method includes forming a slurry including the hydrocarbon feedstock and the salt.

The cation of the salt can include any alkali metal or alkaline earth metal. For example, the salt includes a potassium salt, a sodium salt, a calcium salt, or a combination thereof. In some embodiments, the salt includes a potassium salt. In some embodiments, the salt includes an acetate salt, an oxalate salt, a carbonate salt, a bicarbonate salt, a chloride salt, a hydroxide salt, or a combination thereof. For example, the salt includes an acetate salt, an oxalate salt, a carbonate salt, a bicarbonate salt, or a combination thereof. In some embodiments, the salt includes potassium acetate or potassium bicarbonate. In some embodiments, the salt includes potassium acetate. In some embodiments, the salt includes potassium hydroxide. In some embodiments, the salt does not include potassium hydroxide. In some embodiments, the salt is a non-corrosive salt. Corrosive materials are typically damaging to the environment and living organisms and requires special care when handing. Non-corrosive materials are typically safe to handle in large quantities and does not pose significant threat to the environment.

The pore size of the activated carbon can be altered based on the salt to hydrocarbon ratio. Without wishing to be bound by theory, the method disclosed herein allows for the carbonization process to occur between a gaseous hydrocarbon and one or more salts. The salts induce carbonization as well as the formation of porous activated carbon. In some embodiments, a higher salt to carbon ratio results in a more porous carbon, and therefore produces activated carbon with a higher surface area. In other words, the pore size and pore distribution can be affected by the size and diameter of salt. In some embodiments, a salt to hydrocarbon weight ratio is in the range of 0.5 to 4. Higher salt to hydrocarbon ratios can yield activated carbon with higher surface area due to the increase of the carbonization surface.

In some embodiments, the pyrolysis is carried out in the presence of two or more salts, wherein each salt includes an alkali metal or an alkaline earth metal. In some embodiments, the two or more salts include potassium chloride, potassium hydroxide, or both. In some embodiments, the two or more salts do not include potassium hydroxide. In some embodiments, the presence of a second salt (in addition to a first salt as activating reagent) can tune the pore size of the activated carbon. For example, a salt that reacts with porous carbon at a temperature of greater than 600° C., such as potassium chloride or potassium hydroxide, may be utilized to etch some of the carbon and increase the pore volume. In some embodiments, the method includes forming a slurry including the hydrocarbon feedstock and the two or more salts.

The pyrolysis can be carried out at any suitable temperature. The method disclosed herein allows for the pyrolysis reaction to occur at lower temperatures compared to other reported methods, as carbonization of the gas or liquid feedstock can occur at much lower temperature than typical carbon pyrolysis methods for solid carbon production. For example, the pyrolysis is carried out in the range of about 600° C. to about 700° C., or about 600° C. to about 650° C. In some embodiments, the pyrolysis is carried out at about 600° C. In some embodiments, the pyrolysis is carried out at a temperature lower than 750° C. to avoid the formation of potassium metal.

The pyrolysis can be carried out at any suitable pressure. In some embodiments, the pyrolysis is carried out at a pressure of about 1 bar, or at a pressure of greater than 1 bar. In some embodiments, the pyrolysis is carried out at a pressure in the range of 1 to 10 bars.

The method can produce activated carbon at a yield in the range of about 5 wt. % to about 50 wt. %, wherein the yield can depend on the pressure, temperature, and salt to hydrocarbon ratio at which the pyrolysis is carried out. In some embodiments, the method produces activated carbon at a yield in the range of about 10 wt. % to about 30 wt. %, such as about 15 wt. %. In some embodiments, the method produces activated carbon at a yield in the range of about 10 wt. % to about 20 wt. % when the pyrolysis is carried out at a pressure of about 1 bar. In some embodiments, the method produces activated carbon at a yield in the range of about 10 wt. % to about 30 wt. % when the pyrolysis is carried out at a pressure greater than about 1 bar.

In some embodiments, the pyrolysis is carried out under an oxygen deficient environment. As used herein, an "oxygen deficient environment" refers to an environment having an oxygen content below 10 ppm. For example, the oxygen deficient environment may be an inert atmosphere, such as a nitrogen gas atmosphere, an argon atmosphere, or a steam atmosphere. In some embodiments, the oxygen deficient environment is a nitrogen atmosphere.

The activated carbon produced from the method disclosed herein may have a sheet-like morphology. In some embodiments, the activated carbon has pores throughout the sheet-like morphology. In some embodiments, the activate carbon has a surface area of about 700 to about 900 $m^2/g$, such as about 800 $m^2/g$. In some embodiments, the activated carbon is microporous. In some embodiments, the activated carbon has an average pore width of less than 2 nm.

In addition to the activated carbon, the method can produce one or more hydrocarbon products, such as liquid cracked hydrocarbons and gaseous cracked hydrocarbons. In some embodiments, the one or more hydrocarbon products have a lower molecular weight than the hydrocarbon feedstock. In some embodiments, the method results in carking and carbonizing the aliphatic chains in the hydrocarbon feedstock.

In some embodiments, the method produces a hydrocarbon product with a higher aromatic content than the hydrocarbon feedstock. Without wishing to be bound by theory, the reaction between the hydrocarbon feedstock and the salt can occur in the saturated portion of the hydrocarbon feedstock, leaving a product more enriched with aromatics after the carbonization process.

In some embodiments, the hydrocarbon product is thermally cracked naphtha. The thermally cracked naphtha may have applications as a feed for catalytic reforming to benzene, toluene, and mixed xylenes (BTX) aromatics.

Figure 3:
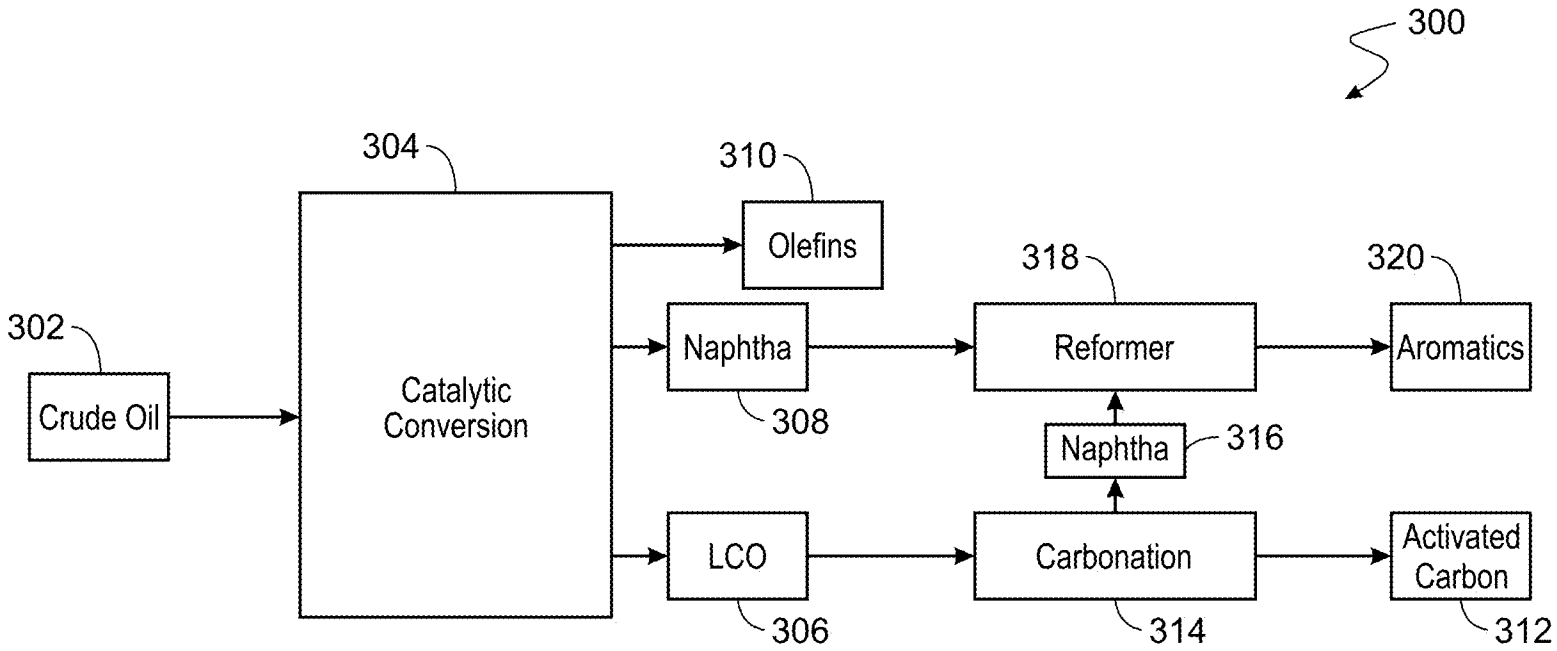
FIG. 3 depicts an example process where crude oil is converted into various products including light cycle oil (LCO), which is subsequently converted into activated carbon and napththa according to the method disclosed herein.

FIG. 3 shows an example process 300 where crude oil 302 is processed by a catalytic converter unit 304 to produce LCO 306, naphtha 308, and olefins 310. The LCO 306 is then used as a feedstock to produce activated carbon 312 according to the method disclosed herein utilizing reactor 314 to obtain a yield of about 15 wt. % activated carbon 312, as well as naphtha 316 at a yield of about 75 wt. %. In some embodiments, the reactor 314 is a pyrolysis reactor, a coking unit, or a furnace. The naphtha 308 and 316 is then processed by a reformer 318 to produce a hydrocarbon product enriched with aromatics 320.

As used in this disclosure, the term "about" can allow for a degree of variability in a value or range, for example, within 10%, within 5%, or within 1% of a stated value or of a stated limit of a range.

Values expressed in a range format should be interpreted in a flexible manner to include not only the numerical values explicitly recited as the limits of the range, but also to include all the individual numerical values or sub-ranges encompassed within that range as if each numerical value and sub-range is explicitly recited.

Particular embodiments of the subject matter have been described. Other implementations, alterations, and permutations of the described embodiments are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

EXAMPLES

Example 1: Light Cycle Oil (LCO) Feedstock

Properties of an exemplary liquid LCO feedstock are shown in Table 1.

TABLE 1

| Analysis | Units | Expected Value Case1/Case2 | Test Method |
|---|---|---|---|
| Production | Kg/hr | 80,627/98,098 | |
| Production | MBOD | 12.8/15.8 | |
| Specification | | | |
| Flash Point, min | ° C. | 65 | ASTM D-93 |
| Distillation, 95%, max | ° C. | 360 | ASTM D-86 |
| Other Properties | | | |
| Specific Gravity | @ 15.5 C. | 0.9553 | ASTM-D-1298 |
| Cetane Number | | 20.1 | ASTM D-613 |
| Cetane Index | | 21.9 | ASTM D-976 |
| Cloud Point | ° C. | −23 | ASTM D-2500 |
| Color | | 2 | ASTM D-1500 |
| API Gravity | | 16.62 | ASTM D-287 |
| Sulfur | ppm wt | 2260/1729 | ASTM D-3120 |
| Aluminum + Silicon, max | ppm wt | 80 | ASTM D-5184 |
| Nitrogen | ppm wt | 36 | ASTM D-4629 |
| UOP K factor | | 10.4 | |
| Viscosity @ 50° C. | cStoke | 2.47/2.54 | ASTM D-445 |
| Viscosity @ 40° C. | cStoke | 3.03/3.13 | ASTM D-445 |
| Distillation | | | ASTM D-86 |
| IBP | ° C. | 176 | |
| 5% | ° C. | 219 | |
| 10% | ° C. | 230 | |
| 30% | ° C. | 247 | |
| 50% | ° C. | 264 | |
| 70% | ° C. | 283 | |
| 90% | ° C. | 319 | |
| 95% | ° C. | 333 | |
| EBP | ° C. | 354 | |

Example 2: Heavy Cycle Oil (HCO) Feedstock

Properties of an exemplary liquid HCO feedstock are shown in Table 2.

TABLE 2

| Analysis | Units | Expected Value Case 1/Case 2 | Test Method |
|---|---|---|---|
| Production | kg/hr | 25556/41,444 | |
| Production | MBOD | 3.5/5.8 | |
| Specification | | | |
| Flash Point, min | ° C. | 65 | ASTM D-93A |
| Other Properties | | | |
| Specific Gravity @ 15.5° C. | | 1.0928 | ASTM D-1298 |
| API Gravity, max | | 10 | ASTM D-287 |
| Viscosity @ 100° C. | cSt | 8.13/8.98 | ASTM D-445 |
| Viscosity @ 50° C. | cSt | 115.2/133.6 | ASTM D-445 |
| Sulfur | wt % | 6330/4839 | ASTM D-2622 |
| Nitrogen, | ppm wt | 1770 | ASTM D-3228 |
| UOP K | | 9.844 | |

TABLE 2-continued

| Analysis | Units | Expected Value Case 1/Case 2 | Test Method |
|---|---|---|---|
| BS&W | ppm wt | 500 | ASTM D-96 |
| Aluminum + Silicon, max | ppm wt | 80 | ISO 10478 |
| Ash, max | wt % | 0.10 | ASTM D-482 |
| Carbon Residue, max | wt % | 18 | ASTM D-189 |
| Sediment by Extraction, max | wt % | 0.12 | ASTM D-473 |
| Pour Point | ° C. | 28.5/29.7 | |
| Distillation | | | |
| IBP | ° C. | 192 | ASTM D-86 |
| 5% | ° C. | 350.8 | ASTM D-1160 |
| 10% | ° C. | 368.6 | ASTM D-1160 |
| 30% | ° C. | 389.9 | ASTM D-1160 |
| 50% | ° C. | 409.2 | ASTM D-1160 |
| 70% | ° C. | 449.0 | ASTM D-1160 |
| 90% | ° C. | 510.6 | ASTM D-1160 |
| 95% | ° C. | 534.2 | ASTM D-1160 |
| 99% | ° C. | 558.8 | ASTM D-1160 |

Example 3: Pyrolysis

Figure 4:
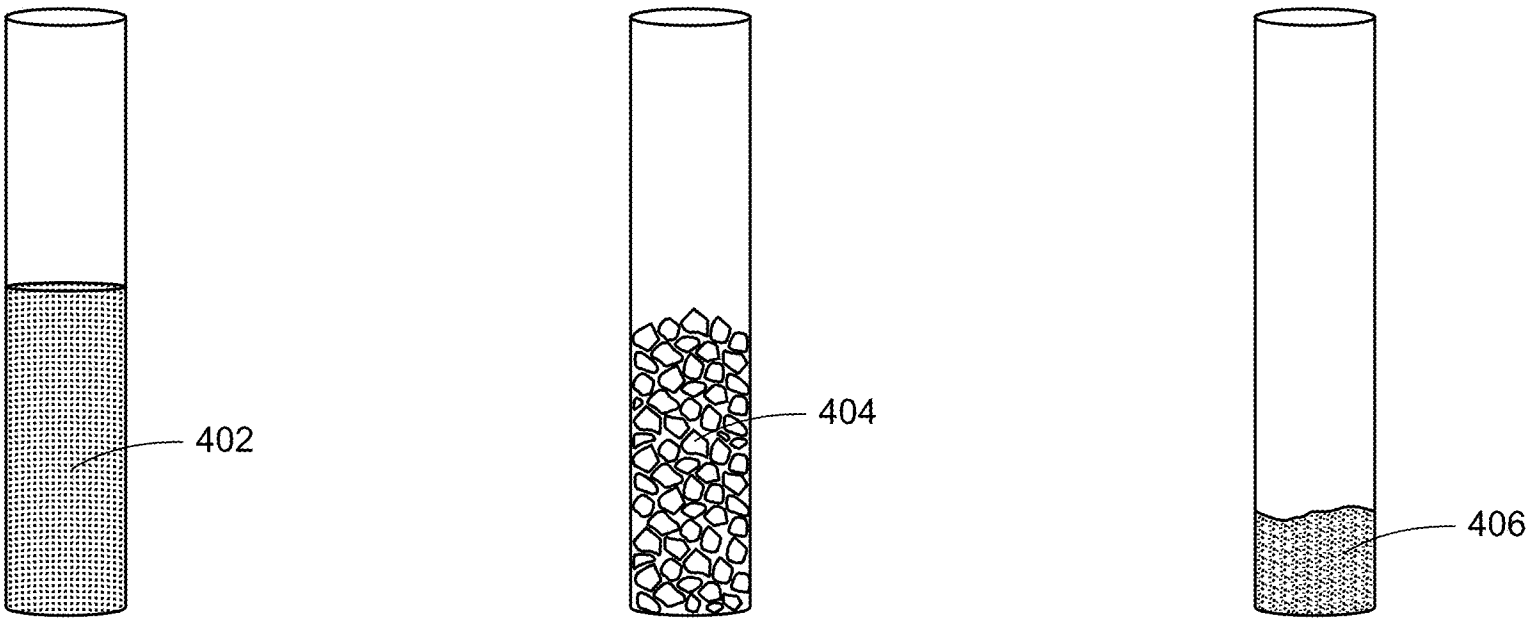
FIG. 4 is a picture of a liquid hydrocarbon feedstock before pyrolysis, the feedstock after mixing with a salt, and the produced activated carbon after pyrolysis.

Solid activated carbon was produced from the light cycle oil (LCO) feedstock of Example 1 by pyrolysis of the light cycle oil with acetate salt. FIG. 4 shows a picture of the initial cycle oil feed 402, which is a liquid, the feed mixed with potassium acetate to form slurry 404, and the produced solid activated carbon 406.

Figure 5:
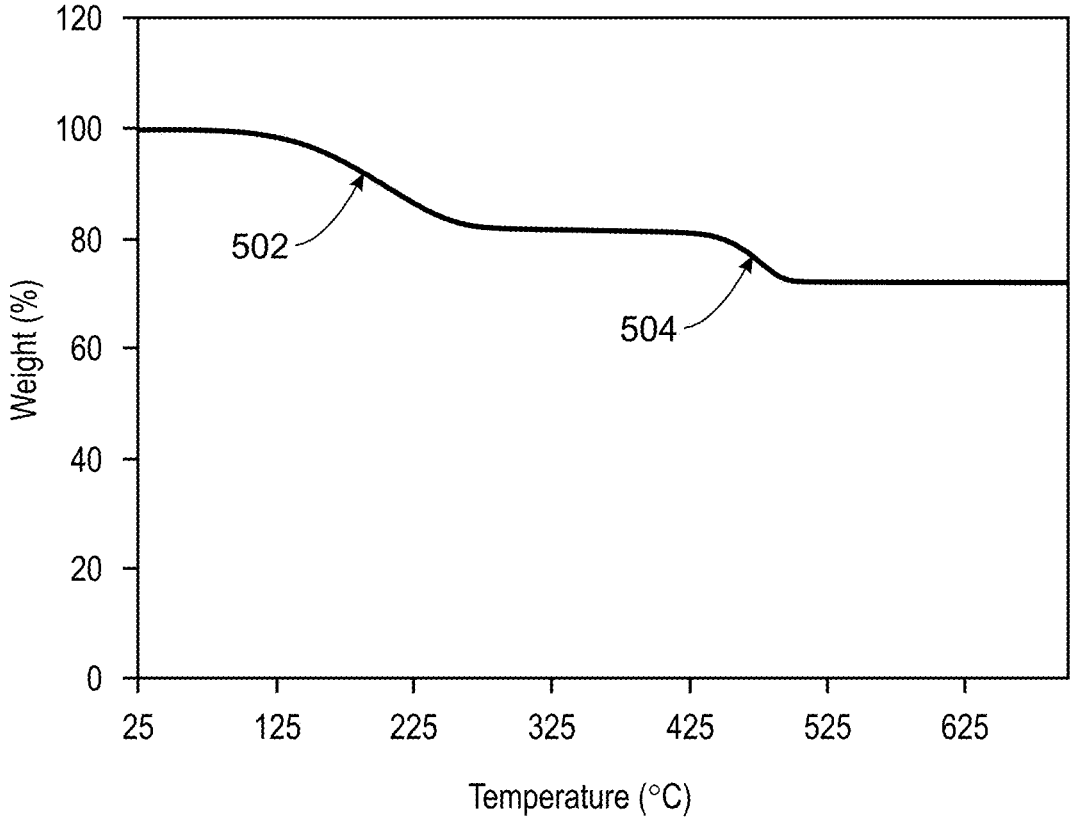
FIG. 5 is a thermogram of the pyrolysis of a light cycle oil (LCO) and potassium acetate mixture under nitrogen.

The pyrolysis was performed under nitrogen in a thermal gravimetric analyzer where change in weight was monitored, as shown in FIG. 5. Point 502 indicates that upon heating, LCO was converted into vapor at around 200° C. Point 504 indicate the temperature at which acetate decomposition and carbon formation begins. Potassium acetate is considered the pre-catalyst, which decomposes into potassium carbonate and acetone. The produced potassium carbonate then acts as a carbonating reagent and reacts with the LCO vapors, which leads to solid carbon formation.

Figure 6:
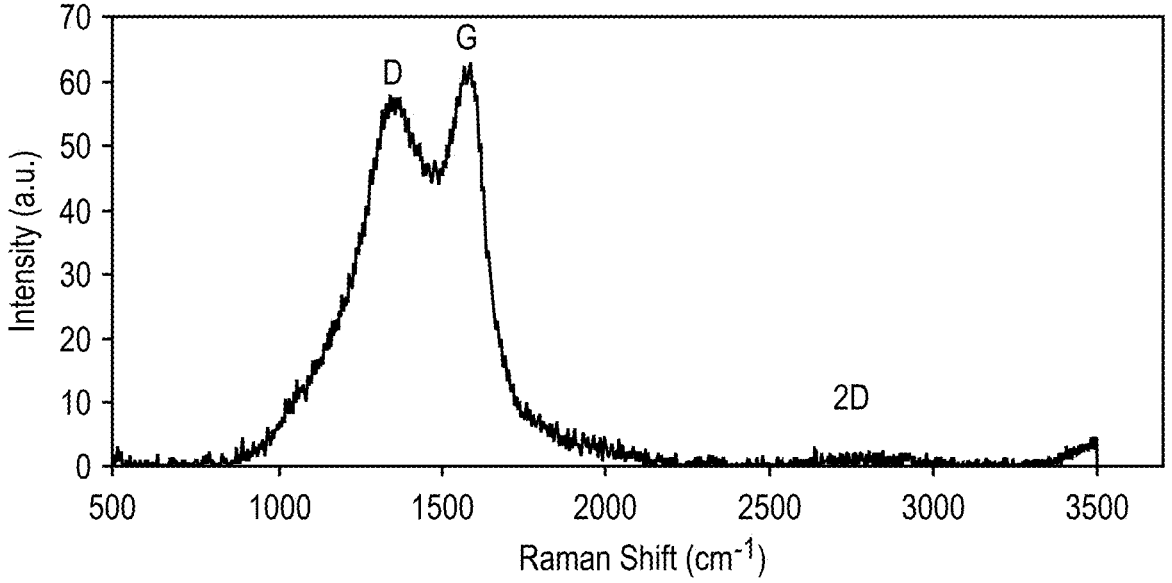
FIG. 6 is a Raman spectrum of activated carbon produced by the method disclosed herein.
Figure 7A:
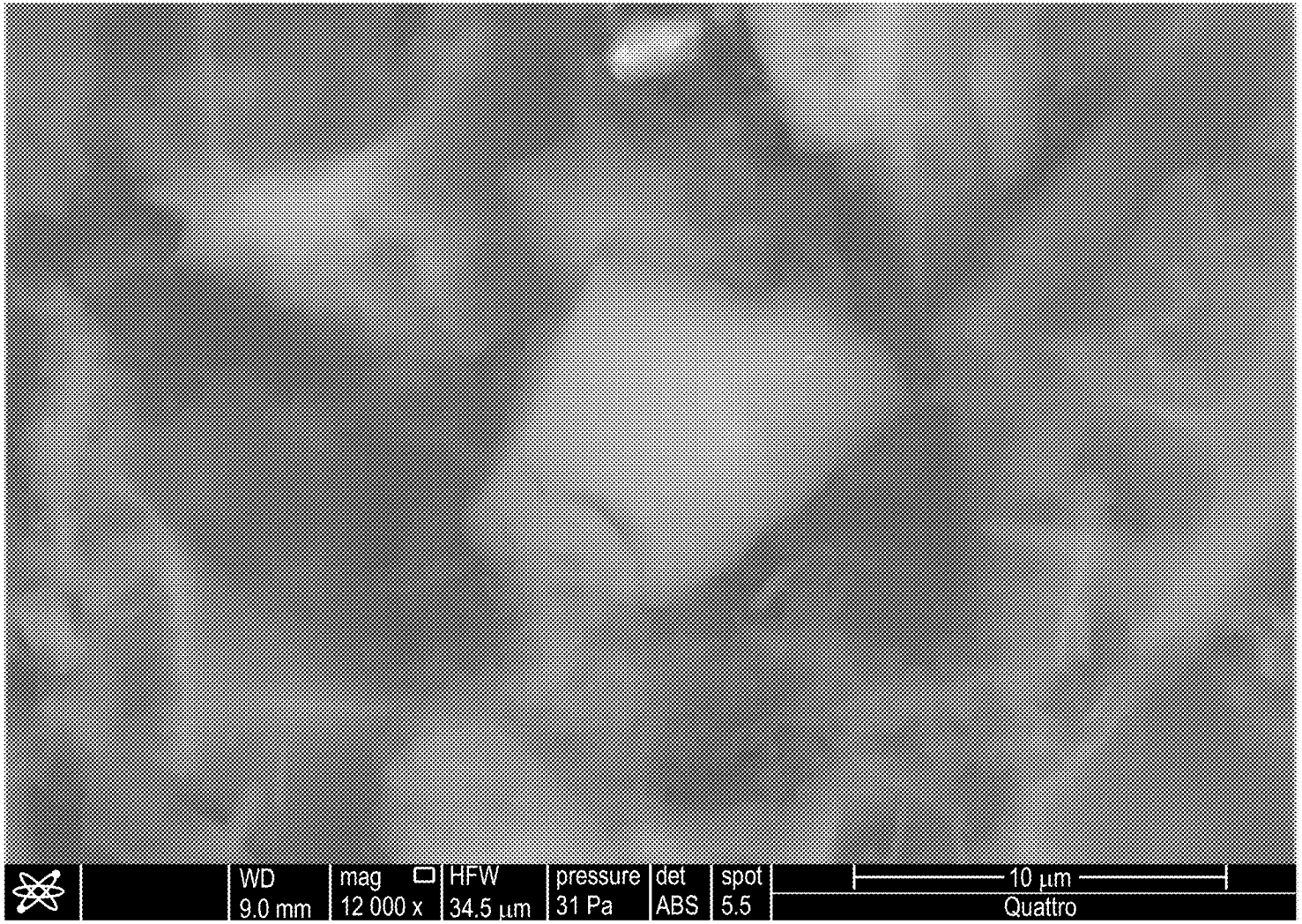
FIG. 7A is a scanning electron microscopy (SEM) image of activated carbon produced by the method disclosed herein.
Figure 7B:
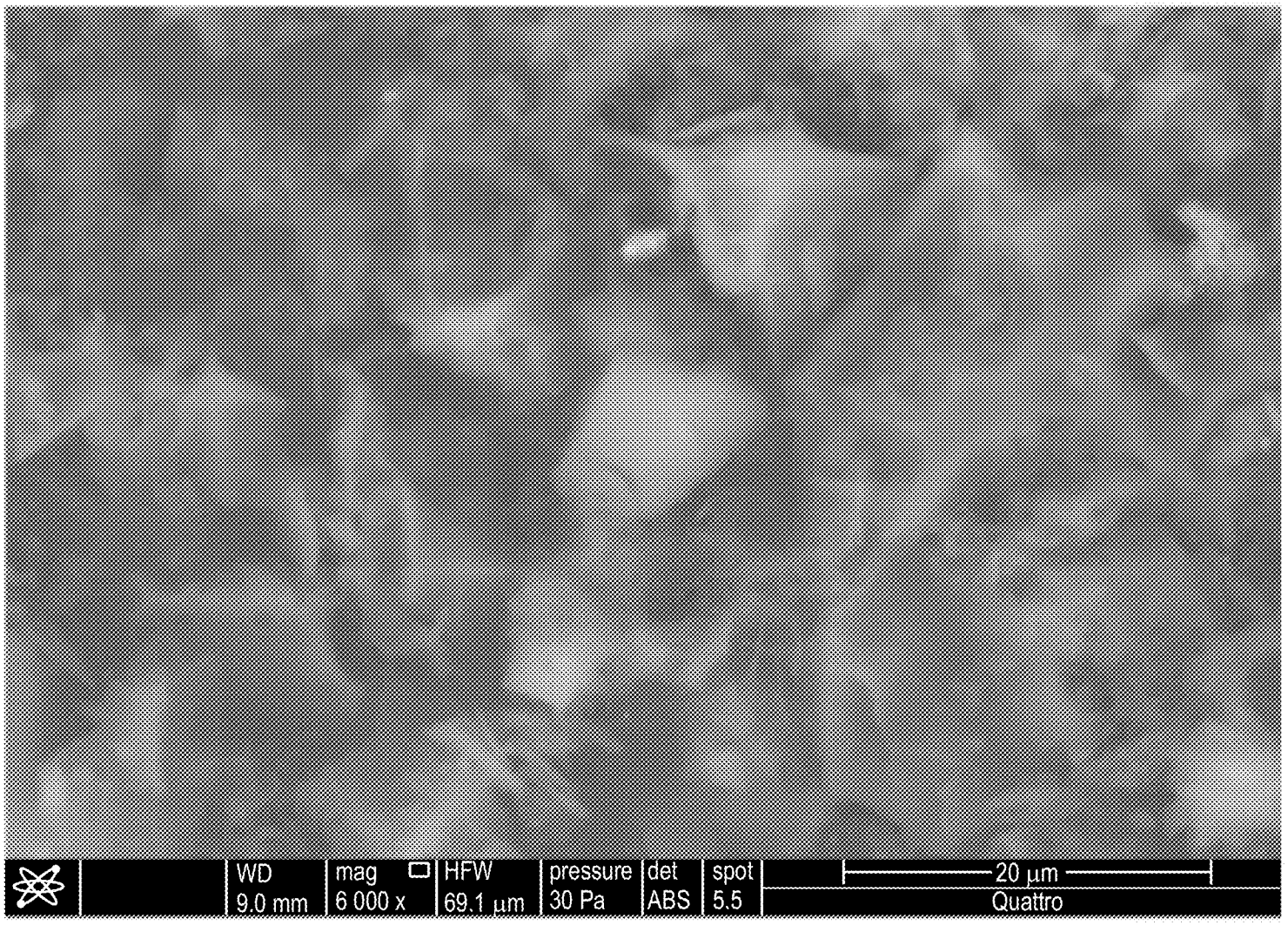
FIG. 7B is a scanning electron microscopy (SEM) image of activated carbon produced by the method disclosed herein.
Figure 7C:
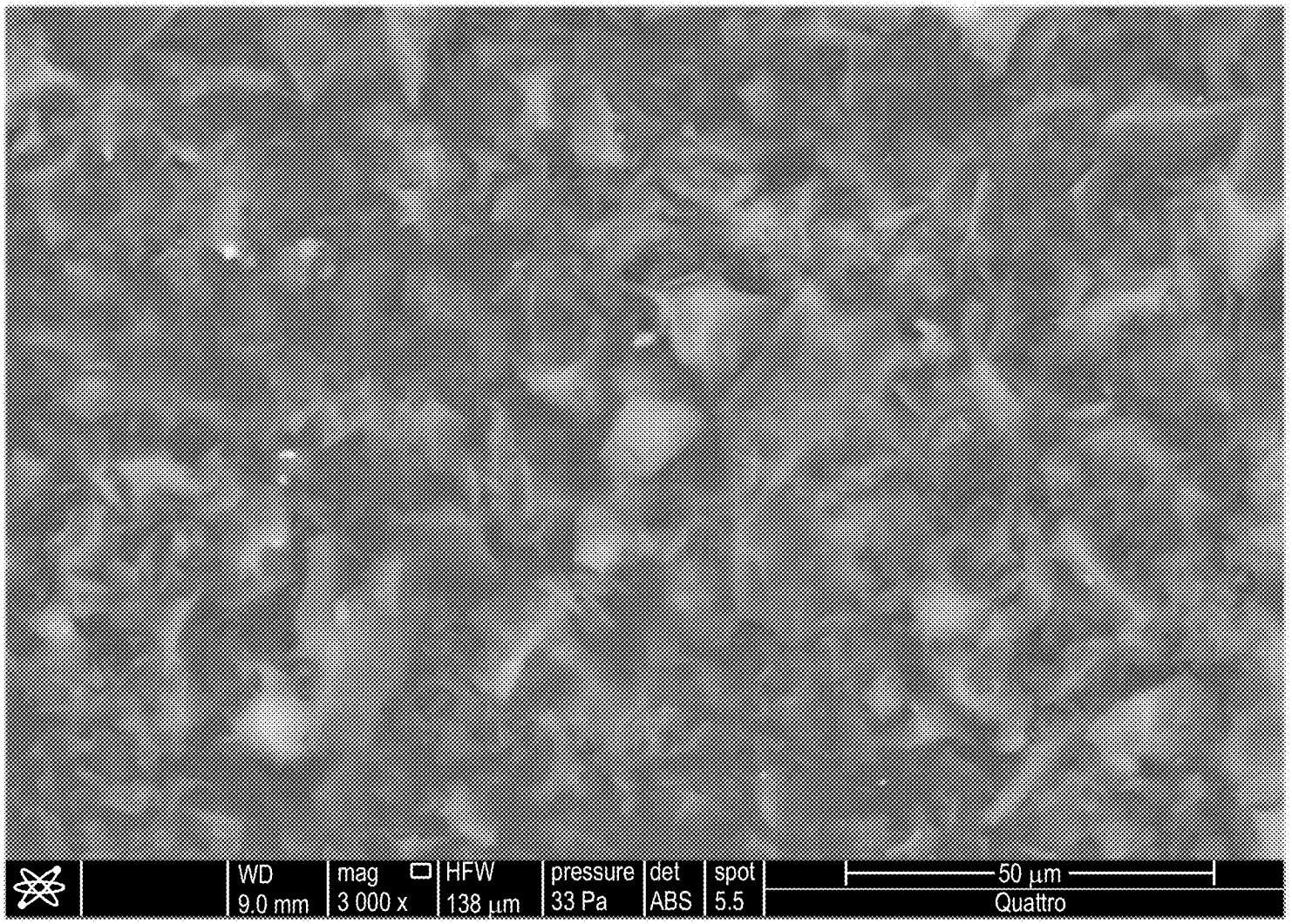
FIG. 7C is a scanning electron microscopy (SEM) image of activated carbon produced by the method disclosed herein.
Figure 7D:
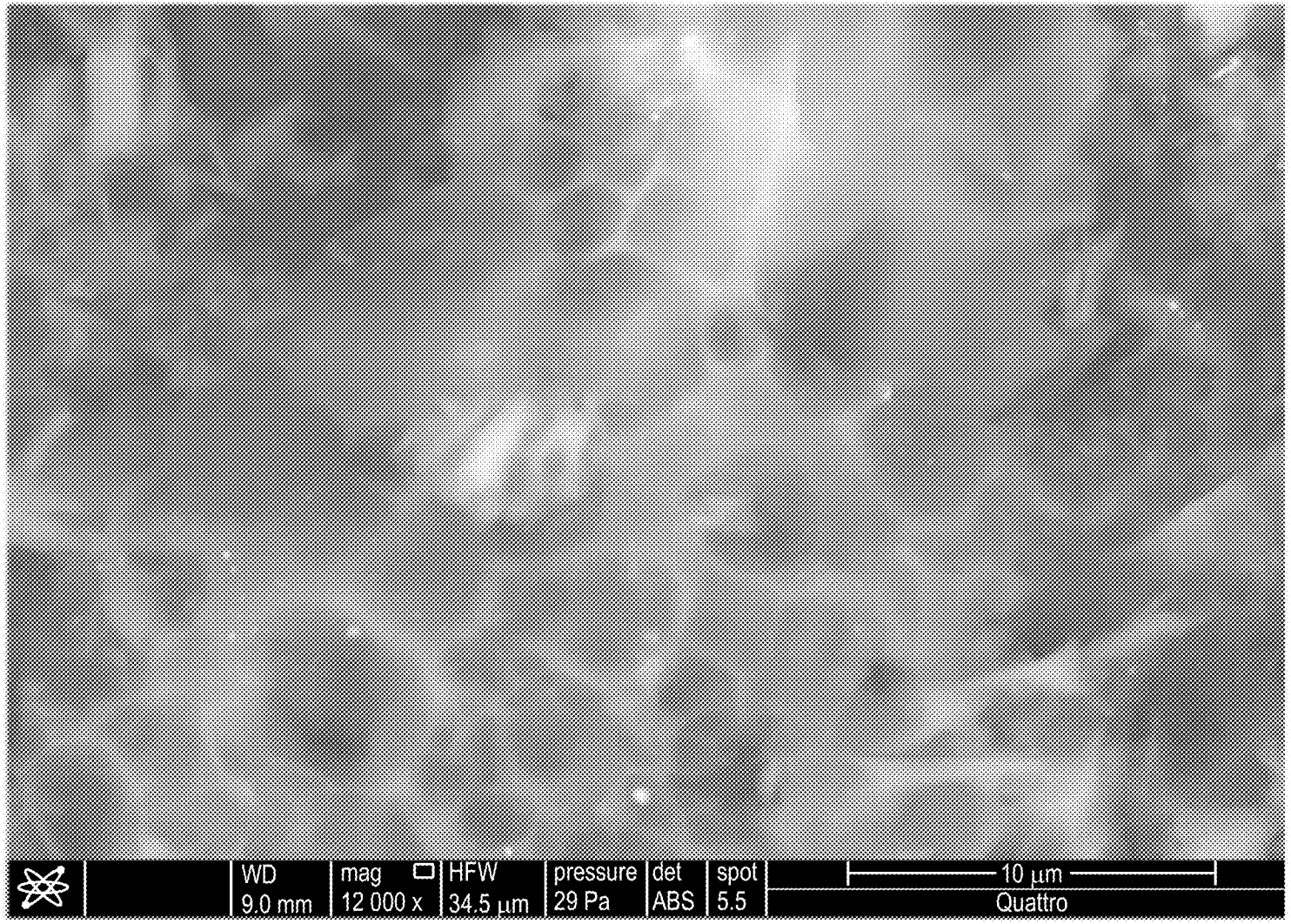
FIG. 7D is a scanning electron microscopy (SEM) image of activated carbon produced by the method disclosed herein.
Figure 7E:
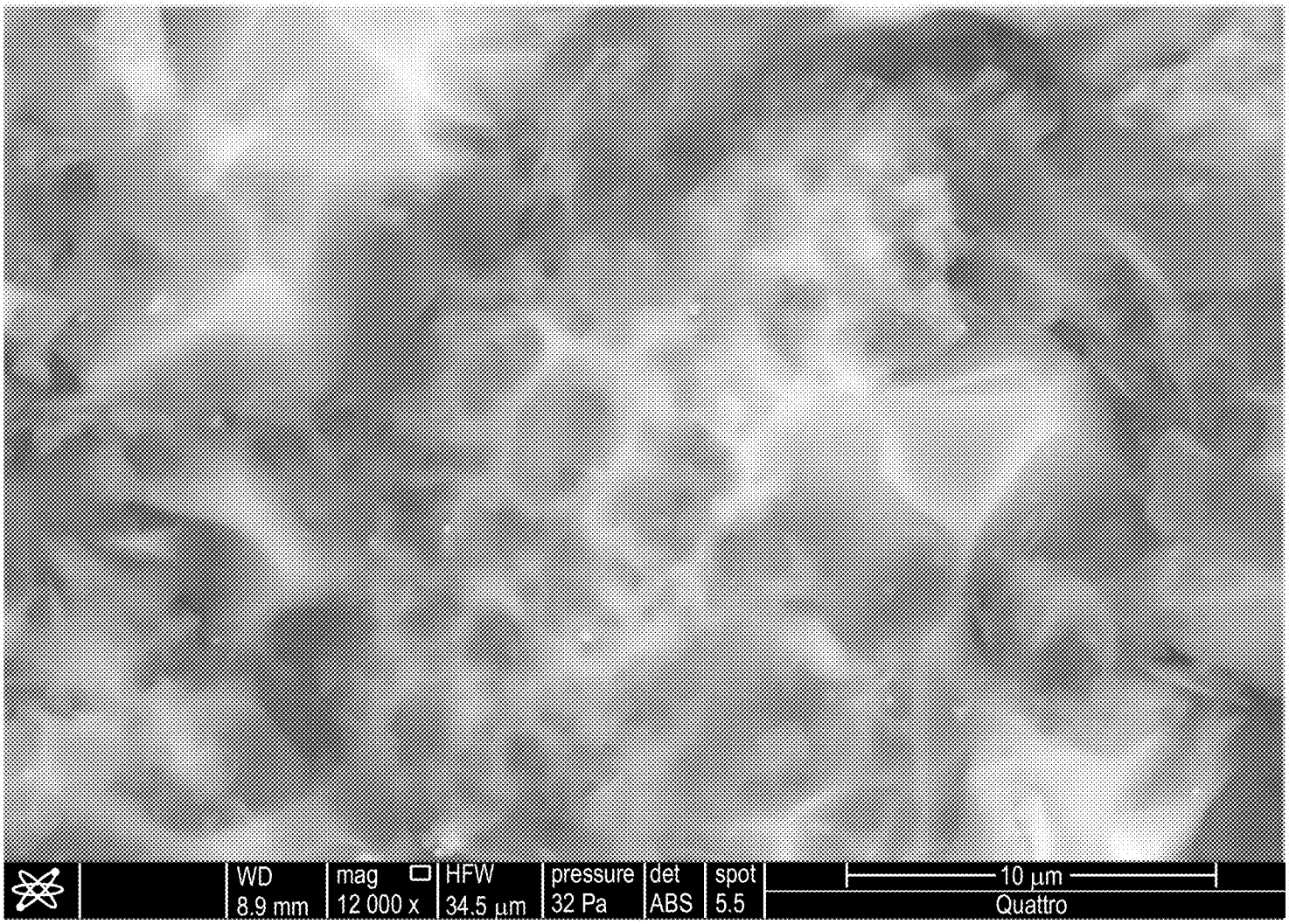
FIG. 7E is a scanning electron microscopy (SEM) image of activated carbon produced by the method disclosed herein.
Figure 7F:
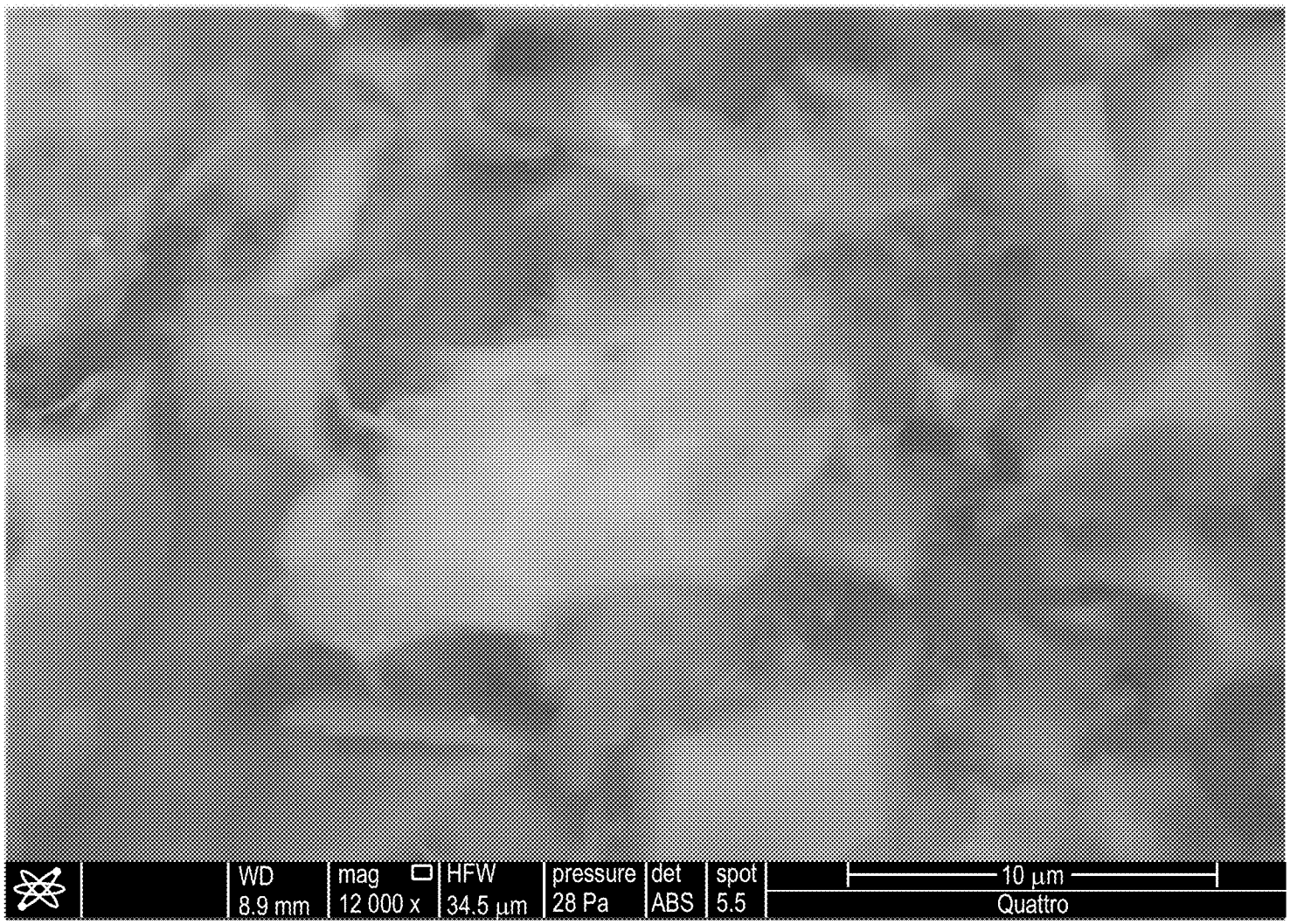
FIG. 7F is a scanning electron microscopy (SEM) image of activated carbon produced by the method disclosed herein.

The obtained activated carbon was washed and dried. FIG. 6 shows a Raman spectrum of the carbon product, with D, G, and 2D bands labeled. The absence of sharp peaks in the 2D bands indicates low crystallinity, consistent with an amorphous and porous nature of the carbon.

FIGS. 7A-7F show scanning electron microscope (SEM) images of the activated carbon product. It was found that the carbon exhibits a porous sheet-like morphology.

Figure 8:
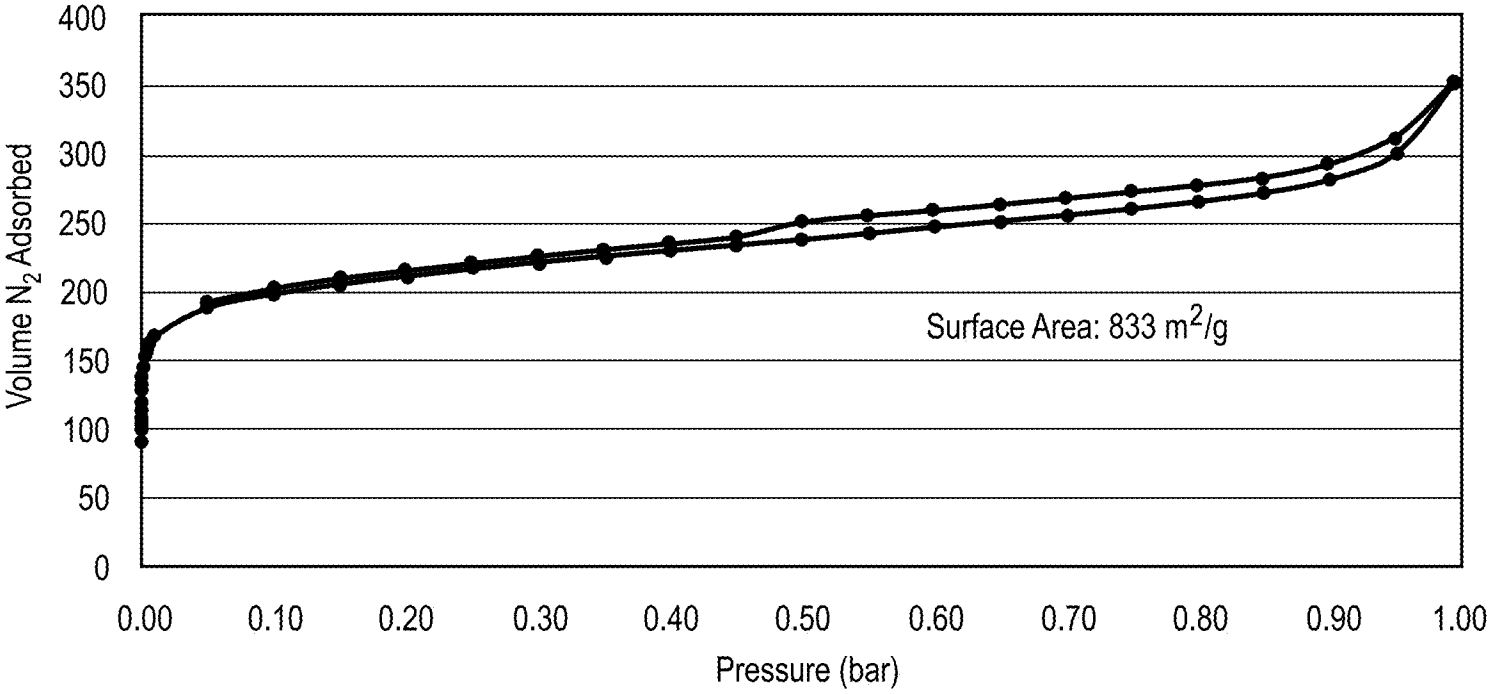
FIG. 8 is a BET analysis plot of activated carbon produced by the method disclosed herein.
Figure 9:
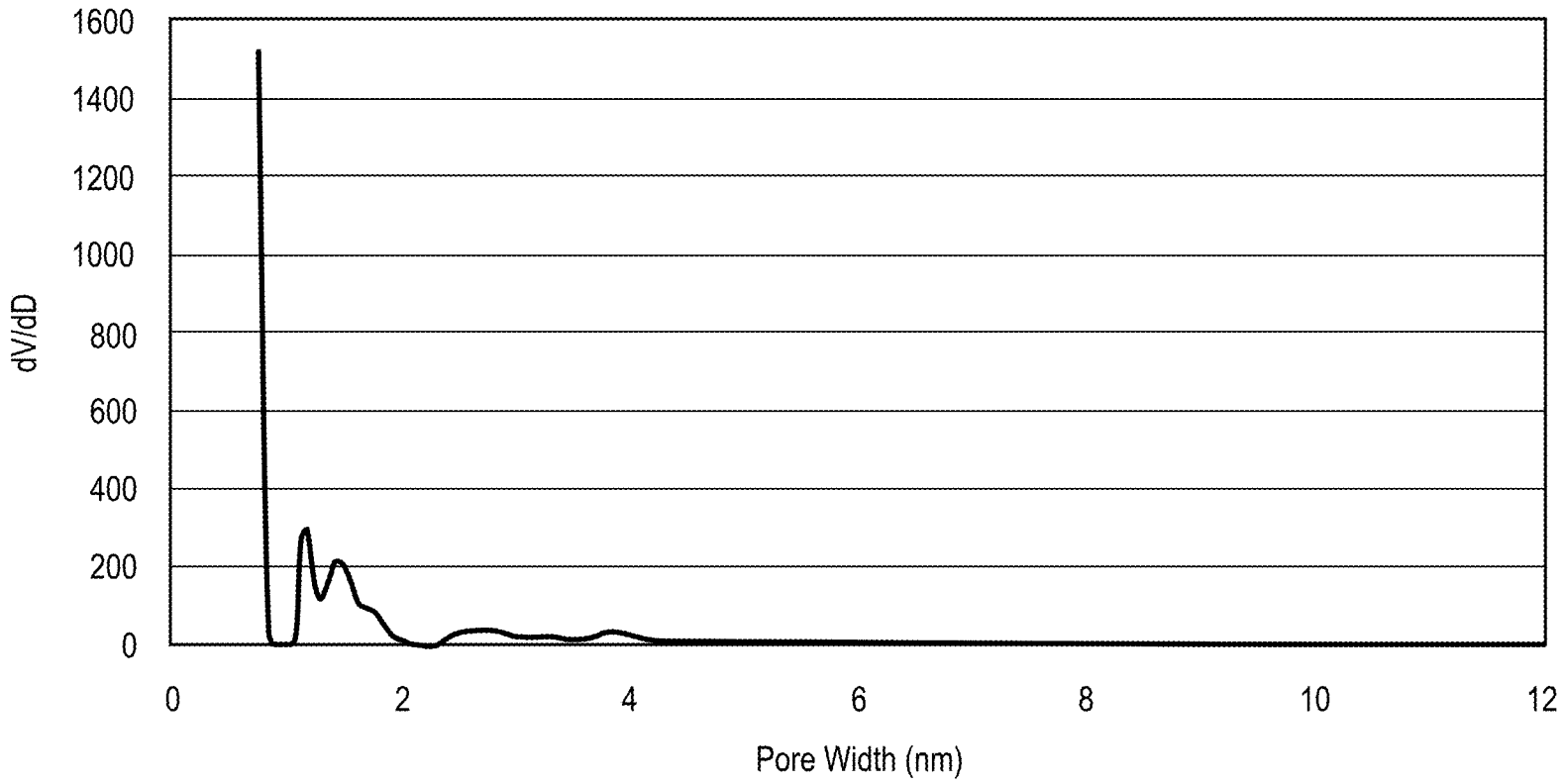
FIG. 9 is a pore size distribution plot of activated carbon produced by the method disclosed herein.

Example 4: Characterization of Surface Area and Pore Size Distribution of Activated Carbon Activated carbon was produced from LCO at a temperature of 600° C. and pressure of 1 bar. The surface area of the activated carbon was calculated by BET analysis and found to be about 833 $m^2/g$, as shown in FIG. 8. FIG. 9 shows the pore size distribution of the activated carbon, where dV/dD is the change in volume per unit of pore diameter. As shown in FIG. 9, most of the pore population has a pore width of less than 2 nm, indicating that the carbon is microporous.

Embodiments

An embodiment described herein provides a method of producing activated carbon. The method includes pyrolyzing a hydrocarbon feedstock in the presence of a salt, wherein the hydrocarbon feedstock comprises a gas hydrocarbon, a liquid hydrocarbon, or both; and the salt comprises an alkali metal, an alkaline earth metal, or both.

In an aspect, combinable with any other aspect, the hydrocarbon feedstock includes a liquid hydrocarbon.

In an aspect, combinable with any other aspect, the hydrocarbon feedstock includes a mixture of hydrocarbons having a boiling point range within about 150° C. to about 600° C.

In an aspect, combinable with any other aspect, the mixture of hydrocarbons has a boiling point range of about 150° C. to about 400° C.

In an aspect, combinable with any other aspect, the mixture of hydrocarbons has a boiling point range of about 160° C. to about 360° C.

In an aspect, combinable with any other aspect, the mixture of hydrocarbons has a cetane number in a range of about 15 to about 25.

In an aspect, combinable with any other aspect, the hydrocarbon feedstock comprises a mixture of hydrocarbons having a boiling point range within about 180° C. to about 600° C.

In an aspect, combinable with any other aspect, at least about 90% of the mixture of hydrocarbons has a boiling point range of about 300° C. to about 600° C.

In an aspect, combinable with any other aspect, the salt comprises a potassium salt, a sodium salt, a calcium salt, or a combination thereof.

In an aspect, combinable with any other aspect, the salt comprises a potassium salt.

In an aspect, combinable with any other aspect, the salt comprises an acetate salt, an oxalate salt, a carbonate salt, a bicarbonate salt, or a combination thereof.

In an aspect, combinable with any other aspect, the salt comprises potassium bicarbonate, potassium acetate, or a combination thereof.

In an aspect, combinable with any other aspect, the salt comprises potassium acetate.

In an aspect, combinable with any other aspect, the pyrolysis is carried out at a temperature in the range of about 600° C. to about 700° C.

In an aspect, combinable with any other aspect, the pyrolysis is carried out in the presence of two or more salts.

In an aspect, combinable with any other aspect, the two or more salts comprise potassium chloride, potassium hydroxide, or both.

In an aspect, combinable with any other aspect, the method produces activated carbon at a yield in the range of about 10 wt. % to about 20 wt. % when the pyrolysis is carried out at a pressure of about 1 bar.

In an aspect, combinable with any other aspect, the method produces activated carbon at a yield in the range of about 10 wt. % to about 30 wt. % when the pyrolysis is carried out at a pressure greater than about 1 bar.

In an aspect, combinable with any other aspect, the method produces a hydrocarbon product with a higher aromatic content than the hydrocarbon feedstock.

In an aspect, combinable with any other aspect, the hydrocarbon feedstock is derived from crude oil.

Other implementations are also within the scope of the following claims.

What is claimed is:

1. A method of producing activated carbon comprising pyrolyzing a hydrocarbon feedstock in the presence of a salt, wherein:

the hydrocarbon feedstock comprises light cycle oil, heavy cycle oil, or both; and the salt comprises an alkali metal, an alkaline earth metal, or both.

2. The method of claim 1, wherein the hydrocarbon feedstock comprises light cycle oil.

3. The method of claim 1, wherein the hydrocarbon feedstock comprises a mixture of hydrocarbons having a boiling point range within about 150° C. to about 600° C.

4. The method of claim 3, wherein the mixture of hydrocarbons has a boiling point range of about 150° C. to about 400° C.

5. The method of claim 4, wherein the mixture of hydrocarbons has a cetane number in a range of about 15 to about 25.

6. The method of claim 4, wherein the mixture of hydrocarbons has a boiling point range of about 160° C. to about 360° C.

7. The method of claim 1, wherein the hydrocarbon feedstock comprises a mixture of hydrocarbons having a boiling point range within about 180° C. to about 600° C.

8. The method of claim 7, wherein at least about 90% volume of the mixture of hydrocarbons has a boiling point range of about 300° C. to about 600° C.

9. The method of claim 1, wherein the salt comprises a potassium salt, a sodium salt, a calcium salt, or a combination thereof.

10. The method of claim 9, wherein the salt comprises a potassium salt.

11. The method of claim 1, wherein the salt comprises an acetate salt, an oxalate salt, a carbonate salt, a bicarbonate salt, or a combination thereof.

12. The method of claim 1, wherein the salt comprises potassium bicarbonate, potassium acetate, or a combination thereof.

13. The method of claim 12, wherein the salt comprises potassium acetate.

14. The method of claim 1, wherein the pyrolysis is carried out at a temperature in the range of about 600° C. to about 700° C.

15. The method of claim 1, wherein the pyrolysis is carried out in the presence of two or more salts.

16. The method of claim 15, wherein the two or more salts comprise potassium chloride, potassium hydroxide, or both.

17. The method of claim 1, wherein the method produces activated carbon at a yield in the range of about 10 wt. % to about 20 wt. % when the pyrolysis is carried out at a pressure of about 1 bar.

18. The method of claim 1, wherein the method produces activated carbon at a yield in the range of about 10 wt. % to about 30 wt. % when the pyrolysis is carried out at a pressure greater than about 1 bar.

19. The method of claim 1, wherein the method produces a hydrocarbon product with a higher aromatic content than the hydrocarbon feedstock.

20. The method of claim 1, wherein the salt is not a hydroxide salt.

* * * * *